United States Patent [19]

Parisien

[11] 4,122,630

[45] Oct. 31, 1978

[54] GATE AND SPRING HINGE THEREFORE

[76] Inventor: Rudolph E. Parisien, 891 Rainbow St., Ottawa, Canada

[21] Appl. No.: 740,230

[22] Filed: Nov. 9, 1976

[30] Foreign Application Priority Data

Dec. 1, 1975 [CA] Canada ..... 240806

[51] Int. Cl.[2] ..... E05F 1/10; E05F 1/12

[52] U.S. Cl. ..... 49/386; 16/189; 16/185 V

[58] Field of Search ..... 16/189, 190, 180, 145, 16/185 V, 50; 49/386, 381, 398; 249/143; 256/DIG. 5, 59

[56] References Cited

U.S. PATENT DOCUMENTS

| | | | |
|---|---|---|---|
| 438,987 | 10/1890 | Coffman et al. | 49/386 |
| 1,016,515 | 2/1912 | Nolte | 16/189 |
| 1,062,437 | 5/1913 | Carlson | 16/189 |
| 1,126,067 | 1/1915 | Nolte | 16/189 |
| 3,389,501 | 6/1968 | Harmon | 49/386 |
| 3,728,837 | 4/1973 | Kiefer, Jr. | 256/DIG. 5 |
| 4,007,919 | 2/1977 | Totten | 256/59 |

FOREIGN PATENT DOCUMENTS

| | | | |
|---|---|---|---|
| 29,217 | 9/1931 | Australia | 16/185 V |
| 143,729 | 10/1951 | Australia | 16/189 |

*Primary Examiner*—James Kee Chi
*Attorney, Agent, or Firm*—A. W. Breiner

[57] ABSTRACT

A spring hinge for use with a gate having a frame constructed of channel member joined at the corner by corner keys. The hinge includes a rod having a right angle near one end which is threaded and an elongated slot in the other end. The slotted end is received in a bore in a corner of the gate frame and extends through a bore in the corner key. A helical spring received on the slotted end of the rod has one of its ends retained in the slot the other end is adapted to engage an adjacent wall of the channel member in which it is installed. When the gate is swung open the rod is fixed and one end of the spring is held therein while the other end turns with the gate thereby twisting the spring so as to store energy required to return the gate to the closed position.

1 Claim, 5 Drawing Figures

GATE AND SPRING HINGE THEREFORE

This invention relates to hinges and more particularly to a spring type hinge for a gate or the like.

In known gate hinges a coil spring is provided on the hinge pin on the exterior of the gate frame, one end of the coil is fixed to the hinge pin and the other end is wrapped around the gate frame. The end of the coil wrapped around the gate frame must therefore travel through a greater arc because of its length and is often subject to failure. This tendency is further aggravated by the fact that the spring hinge is exposed to weather, accidental and deliberate damage. Furthermore, due to the fact that the known hinge itself is secured on the outside of the gate frame it is subject to tampering and it may be possible to enter through a locked gate by merely removing the hinges or lifting the gate off the hinge pins.

In the gate hinge system of this invention the hinge pins and the closer spring are inside an adjacent side member of the gate frame and thus cannot be detached from the gate frame while the gate is in the closed and/or locked position.

One of the advantages of the present invention is that the gate hinges are more tamper proof because the hinge pins are concealed in the gate. Furthermore the closer spring is not subject to deliberate or accidental damage nor is it subject to deterioration through the action of weather.

A further advantage of the hinge system of the present invention is that it is pre-assembled, as part of the gate frame, in the factory thereby reducing the time required to install the gate on the site. It will be appreciated that specialized tools and jigs can be used in the factory thereby reducing assembly time.

A still further advantage of the hinge system of the present invention is the improved appearance due to the fact that the closer mechanism is concealed. Furthermore since the hinge pins are inside the gate frame and their attaching means are not on the exterior of the gate there are less protuding fastening means to cause injury to persons or tear their clothing.

It is therefore an object of the present invention to provide gate hinges which are concealed. Accordingly the present invention provides a spring hinge for a gate including a frame consisting of channel member secured together by right angle corner keys the spring hinge comprising a rod having a right angle bend one end of the rod being threaded for engagement with a gate post on opposite end of the rod having a slot therein and passing through an aperture in a corner key of the gate and a helical spring surrounding the opposite end of the rod so that one end of the helical spring is anchored in the slot and an opposite end of the helical spring engages a wall of the channel member of the gate so that opening the gate in one direction will cause the spring to be twisted thereby storing energy to return the gate to a closed position.

In the accompanying drawings which illustrate embodiments of the present invention:

Figure 1:
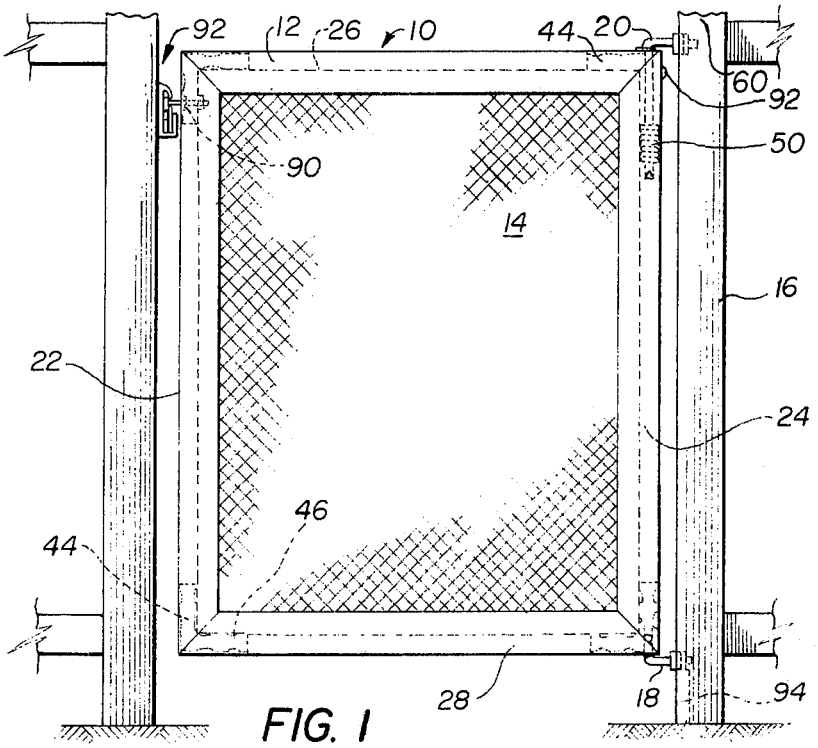
FIG. 1 is a front elevational view of the gate and gate hinges of this invention.

Referring now in detail to the drawings wherein a gate shown generally at 10 in FIG. 1 includes a frame 12 and suitable fence material 14 in this case chain link fencing. The gate 10 is secured to a gate post 16 by hinges 18 and 20.

Since the hinges 18 and 20 are for use with a gate of the type shown at 10 in FIG. 1 it is necessary to describe the gate 10 in some detail. The gate frame consists of two side members 22 and 24 and top and bottom members 26 and 28 respectively which are mitred at their ends.

Figure 3:
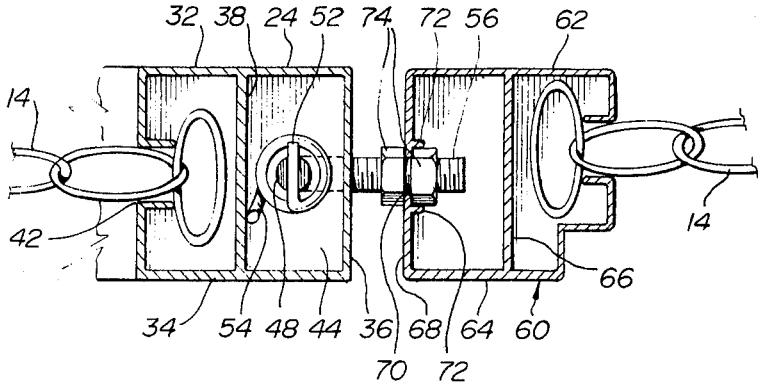
FIG. 3 is a cross sectional view if the spring hinge, gate and gate post taken along the line 3 — 3 of FIG. 1

The frame members 22, 24, 26 and 28 comprise channel type members (as shown in FIG. 3) having side walls 32 and 34 an interconnecting wall 36 and a partition wall 38. Each of the walls 32 and 34 has its outer side edge bent inwardly to provide a substantially J-shaped cross section and define a slot 42 therebetween the square tubular section enclosed by the partition wall 38 strengthens the channel members to minimize twisting.

Figure 4:
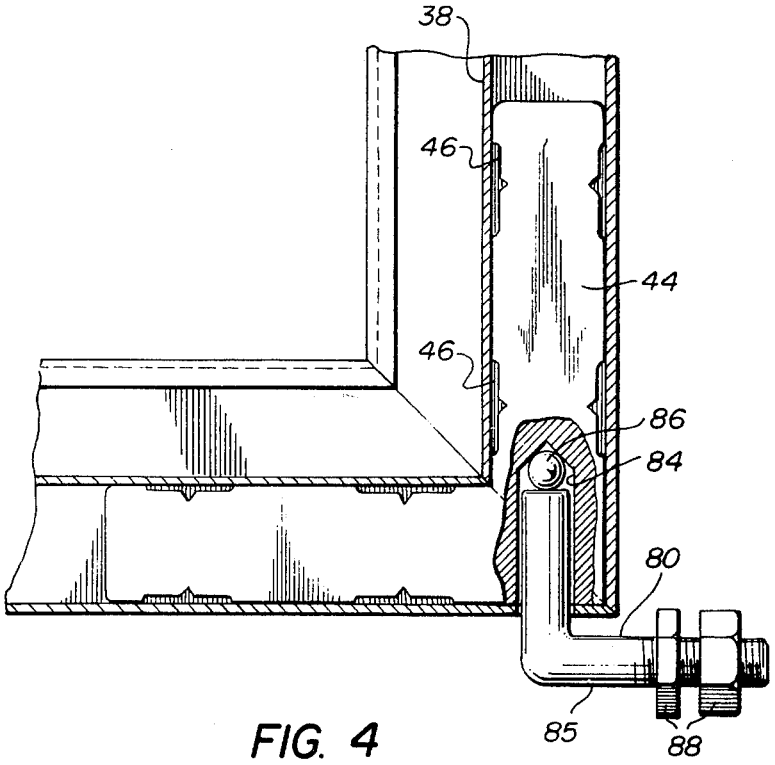
FIG. 4 is an enlarged view of the bottom hinge of FIG. 1

As shown in FIG. 1 the mitred ends of the frame members are secured together by corner pieces or Keys 44 received in the square tubular sections of the frame member. The corner pieces 44 are provided with transverse grooves 46 see FIG. 4, to facilitate crimping the channel members 22, 24, 26 and 28 so as to fasten them to the corner pieces 44 in a manner to be described more fully below.

Figure 2:
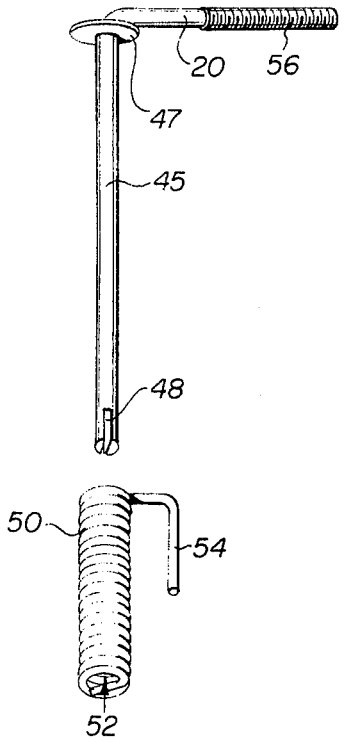
FIG. 2 is an exploded perspective view of the hinge pin and closer spring of FIG. 1

An aperture in the frame member 26 is aligned with a bore extending through the corner piece 44 to receive the sloted end 48 of the hinge pin 45 of the hinge 20. The hinge 45 extends beyond the lower portion of the corner piece 44 so as to receive a helical spring 50 thereon. As shown more clearly in FIGS. 2 and 3 the spring 50 has one end 52 shaped to engage in the slotted end 48 of the hinge pin 45. The other end 54 of the spring 50 extends tangentially from the coil and is bent downwardly so as to engage the partition wall 38 of the side member 24 of the gate. It will be appreciated that because the spring 50 is within the channel member 24 the length of the end 54 of the spring extending from the spring 50 to the adjacent wall can be kept to the absolute minimum thereby reducing the possibility of failure.

The hinge pin 45 has a right angle bend adjacent the upper surface of the frame member 26 so that its threaded end 56 extends toward a gate post shown generally at 60 in FIG. 3.

The gate post 60 is a channel similar in some respects to the channel members of the gate frame. The post 60 has side walls 62 and 64 bent inwardly at their outer ends to define J-shaped portions having a slot there between to receive chain link fencing. An intermediate partition wall 66 interconnects the side walls 62 and 64. A transverse wall 68 remote from said J-shaped portions has a longitudinal slot 70 to receive the threaded end 56 of the hinge pin 45. In order to prevent turning of the inner retaining nut, ridges 72 are provided on each side of the slot 70 on the inner face of the wall 68.

The slot 70 in the gate post 60 receives the threaded end 56 of the hinge pin 45. However, in order to assemble retaining nuts 74 on either side of the wall of the gate post it is desireable to have the retaining nuts 74 in place and slide the threaded end 56 of the hinge pin 20 into place from the top of the post 60. The outer retaining nut 74 is then tightened.

The lower hinge 18 includes a hinge pin 80 in the form of a rod having a threaded end 82 and a right angle bend adjacent its mid portion. The unthreaded end of the pin 80 extends through an aperture in the frame member 28 and into an aligned bore 84 which extends only part way through the corner piece 44. As shown more clearly in FIG. 4 the bore 84 is long enough to allow a ball bearing 86 to be inserted between the end of the hinge pin 85 and the end of the bore, so that the gate 10 will ride on the bearing 86. The hinge 18 is assembled on the post 60 by sliding the pin 85 down the slot 70 with retaining nuts 88 in place in the manner described with reference to the hinge 20.

Figure 5:
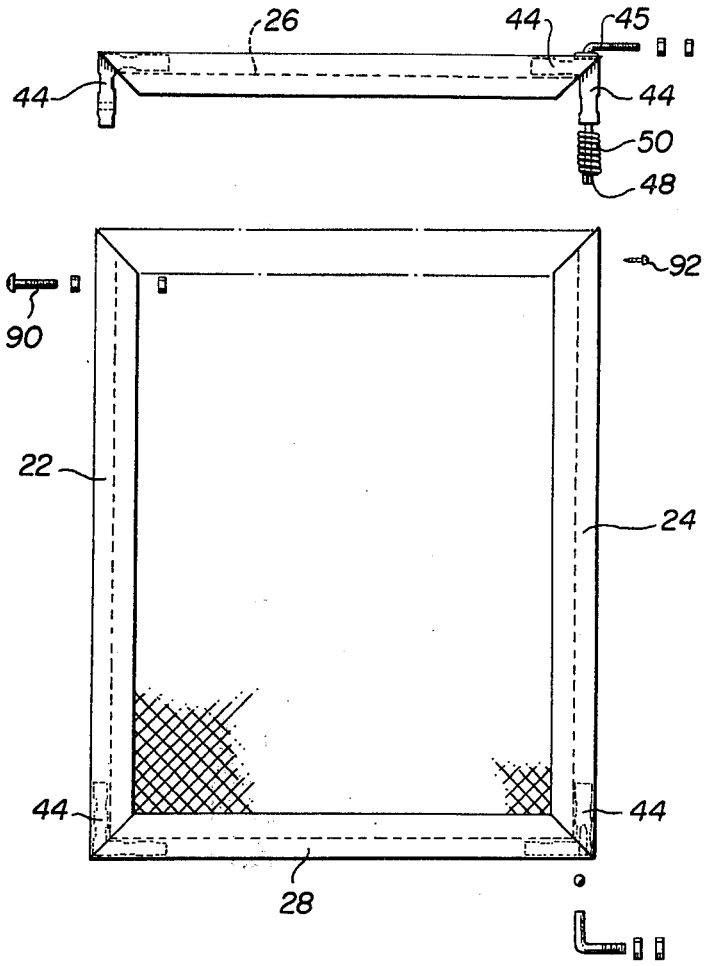
FIG. 5 is an exploded view of the gate and spring hinge during assembly.

With reference to FIG. 5, the gate 10 is assembled by first joining the lower member 28 to the side member 22 and 24 through the use of corner pieces 44. The corner pieces are conveniently secured to the gate frame members through the use of a hydraulically driven die which forces the partition wall 38 of the member inwardly adjacent the side edges of the grooves 46. A section of chain link fencing is then cut so as to be slightly larger than the interior dimensions of the gate frame. The last link on each side of the chain is then loosened at top and bottom so that it can be turned and slid into the slot in each side rail until the bottom edge is in the slot in the bottom member 28.

Before assembling the spring hinge 20 on the gate it is necessary to determine whether a right or left hand gate spring 50 should be used. The spring 50 may be wound clockwise or counter clockwise depending on whether the gate is to swing from the right or left hand gate post or swing in or out. This being done a corner piece 44 having a bore therethrough is inserted in the end of the upper member 26 and the hinge pin 45 is inserted through the aperture in the member and the bore in the corner piece so that its slotted end 48 extends out of corner piece 44. The spring 50 is then slid onto the hinge pin 45 so that its lower end 52 is received in the slotted end 48 of the pin 45 and the slotted end of the pin is squeezed to retain the spring 50.

Provided a corner piece 44 has been slid into the other end of the member 26 the hinge 20 and the member 26 can then be slid into the upper ends of the side members 22 and 24.

It is not desireable to crimp the upper end of the frame since it may be necessary to gain access to the spring hinge 20. Accordingly a bore is provided at one side of the gate to receive the latch pin 90 which holds the member 22 and the corner piece together. However, an adjacent end of the member 26 should be crimped to the corner piece 44. The other end of the member 26 need not be crimped since the hinge pin 45 passes through it but the upper end of the member 24 must be secured to the corner piece 44 and this is accomplished by such means as a self-tapping screw 92.

The assembly of gates such as gate 10 described herein is more fully described in my co-pending Canadian Application No. 193,179 entitled "GATE."

In order to provide for use of the hinge 20 at the bottom of the gate 10 the hinge pin 45 has a collar 47 adapted to support the gate. The hinge pin 45 extends through its associated corner piece 44 at the bottom of the gate and is provided with a spring 50 in the manner described above. The advantage of having a hinge capable of being used on the bottom of the gate is that it is not necessary to provide right and left hand closer springs 50.

With regard to the gate latch 92 shown in FIG. 1 this has been described in my Canadian Application No. 235,968 entitled "Gate Latch". The provision of a gate latch 92 as described in my co-pending application makes it possible to provide a more tamper proof gate since the latch 92 cannot be readily removed nor can the latch finger 90 be disengaged from the latch 92 while the gate latch is locked.

With regard to the hinges 18 and 20 it is recommended that a spacer 94 be placed in the channel in the post 60 before the lower hinge 18 is slid into place so that it would not be possible for the hinge 18 to be loosened so as to be lowered thereby becoming disengaged from the gate. If this is done it is not possible to loosen the retaining nuts and slide the gate up out of the post due to the construction of latch 94, which prevents upward movement of the latch finger 90.

The operation of the gate will be obvious from the foregoing description, however, it should be pointed out that the gate is designed to swing inwardly and outwardly and during movement in one direction. The spring will not engage the wall of the gate frame to twist the spring until the gate has moved through about 90°. This is a desireable feature since at times it is inconvenient to have the closer spring in operation.

The embodiments of the invention in which an exclusive property or privilege is claimed are defined as follows:

1. In combination, a gate, including a frame, and a spring hinge for said gate, said frame including channel members of rectangular cross section secured together by right angle corner keys, said spring hinge comprising a rod having a right angle bend one end of said rod being threaded for engagement with a gate post, an opposite end of said rod having a slot therein and passing through an aperture in a corner key of said gate and a helical spring surrounding said opposite end of said rod so that one end of said helical spring is anchored in said slot and an opposite end of said helical spring engages a wall of said channel member of said gate so that opening said gate in one direction will cause said spring to be twisted thereby storing energy to return said gate to a closed position, whereas the opening of said gate in the opposite direction will not cause said spring to engage, and wherein said spring hinge is constructed and arranged within said gate frame to prevent detachment from said gate frame while the gate is in the closed position.

* * * * *